United States Patent [19]

Weber

[11] Patent Number: 4,766,819

[45] Date of Patent: Aug. 30, 1988

[54] SADDLE FRAME FOR PASSIVE STEERING SINGLE-AXLE TRUCK FOR A RAILWAY FREIGHT CAR

[75] Inventor: Hans B. Weber, Rotonda West, Fla.

[73] Assignee: National Castings, Inc., Oakbrook Terrace, Ill.

[21] Appl. No.: 31,102

[22] Filed: Mar. 26, 1987

[51] Int. Cl.[4] ..... B61F 3/00

[52] U.S. Cl. ..... 105/157.1; 105/463.1

[58] Field of Search ..... 105/157.1, 182.1, 463.1, 105/165, 206.1, 218.1, 220, 222, 223, 224.05, 224.06; 246/DIG. 1, DIG. 2

[56] References Cited

U.S. PATENT DOCUMENTS

| | | | |
|---|---|---|---|
| 3,286,653 | 11/1966 | Weber | 105/165 |
| 3,394,662 | 7/1968 | Weber | 105/165 |
| 3,841,233 | 10/1974 | Sinclair | 105/224.06 |
| 4,109,586 | 8/1978 | Briggs et al. | 105/224.06 |

*Primary Examiner*—Leonard E. Smith

*Attorney, Agent, or Firm*—Milton S. Gerstein; Marvin N. Benn

[57] ABSTRACT

An improved saddle frame for a passive steering single-axle truck for a railway freight car that allows for unobstructed passage of infrared rays from the wheel bearings, so that they may be sensed by a hot-box detector mounted on a rail bed. The saddle frame has a center web section including a pair of parallel lower flanges, which flanges are cut back on the inboard sides thereof to allow for the unobstructed passage of the infrared rays. Each inboard section is of considerably reduced width as compared to the outboard sections, with compensatory thickening being provided for both inboard and outboard sections of the flanges. The inboard sides of the saddle frame's upright columns and spring arms are also cut back at a forty-five degree slope in order to ensure that the infrared rays reach the hot-box detector.

16 Claims, 2 Drawing Sheets

10
20
22
3
16
14
12
18
30
26
26'
34
32
36
24
24'
28
3

SADDLE FRAME FOR PASSIVE STEERING SINGLE-AXLE TRUCK FOR A RAILWAY FREIGHT CAR

BACKGROUND OF THE INVENTION

The present invention is directed to an improved saddle frame for a single-axle truck of a railway freight car, such as that manufactured by National Castings, Inc., under the name of "Unitruck II." In using such a single-axle truck for a railway freight car, it has been discovered that hot-box detection of the wheel bearings of the axle is not adequately carried out because of the projection of the lower flanges of the saddle frame's center web section toward the inboard side thereof, a distance such that the infrared rays from the wheel bearing to the infrared ray-detecting hot-box detector are blocked. Hot-box detectors are typically mounted on the inboard side of the truck side frame on the rail bed adjacent but outboard of the rail thereof, and sense an infrared beam emanating from the wheel bearing in order to determine the amount of heat given off by the respective wheel bearings, in order to determine the state of operating temperature thereof, to decide whether or not the bearing functions satisfactorily. With the conventional single-axle truck, the inboard sections of the flanges project inboardly to such a degree that these infrared rays, which are typically detected at an angle of 45 degrees, are intercepted by the inboard side of the lower flanges to thereby prevent their reaching the hot-box detector from the wheel set and wheel bearing.

SUMMARY OF THE INVENTION

It is, therefore, the main objective of the present invention to provide an improved saddle frame for a single-axle truck for railway freight cars which allows for hot-box detection of the wheel bearings associated with the single-axle truck.

It is another objective of the present invention to provide for such hot-box detection of the truck's wheel bearings in such a way as to not compromise the structural integrity, long life of the truck's saddle frame, and the general functioning of the truck in its intended manner.

Toward these and other ends, the improved saddle frame of the present invention is provided with a lower, center web section thereof, which includes a pair of lower, parallel flanges which interconnect lower portions of the pair of upright columns of the saddle frame. Each of the flanges is unequal in cross section, in that the outboard portion thereof, as defined relative to the longitudinal axis of the center frame, is of greater width than the inboard section thereof. The inboard section thereof is shorter in width in order to allow for the infrared beams from the respective wheel bearing to bypass these lower inboard sections of the flanges, to thereby reach the hot-box detector, to thereby detect the status of the respective wheel bearing. In order to allow for such shortened, or cut back, inboard sections of each of the lower flanges of the center web of the saddle, each inboard section is thicker than the outboard sections thereof, and is also thicker as compared to the equal lengths of the inboard and outboard sections of the conventional lower flanges of the conventional saddle of a single-axle truck.

In order to absorb the same amount of load as the prior art saddle frame, each of the inboard and outboard sections of each of the pair of lower flanges of the center web portion of the saddle frame increases in thickness from the outer end thereof toward the central longitudinal axis of the saddle frame, to provide for increased strength, and to thus increase the load capacity associated with the cut back width of each of the inboard sections of the lower flanges. Also, each of the outboard sections of each of the lower flanges of the center web section is greater in width as compared with the conventional outboard sections of the flanges of the conventional center web section of the conventional single-axle truck.

In association with the cut back width of the inboard sections of the lower flanges of the center web section of the saddle frame, the lower portions of the directly adjacent and connected upright columns, as well as the adjacent portions of the two flange spring-seats of the saddle frame are, on the inboard side of the saddle frame, reduced or cutback in a gradual manner at a 45 degree angle in order to allow for a greater angular acceptance of the infrared beams from the bearing to the hot-box detector mounted inboard of the truck side frame on the rail bed.

BRIEF DESCRIPTION OF THE DRAWINGS

The invention will be more readily undertood with reference to the accompanying drawings, wherein.

DETAILED DESCRIPTION OF THE INVENTION

Figure 1:
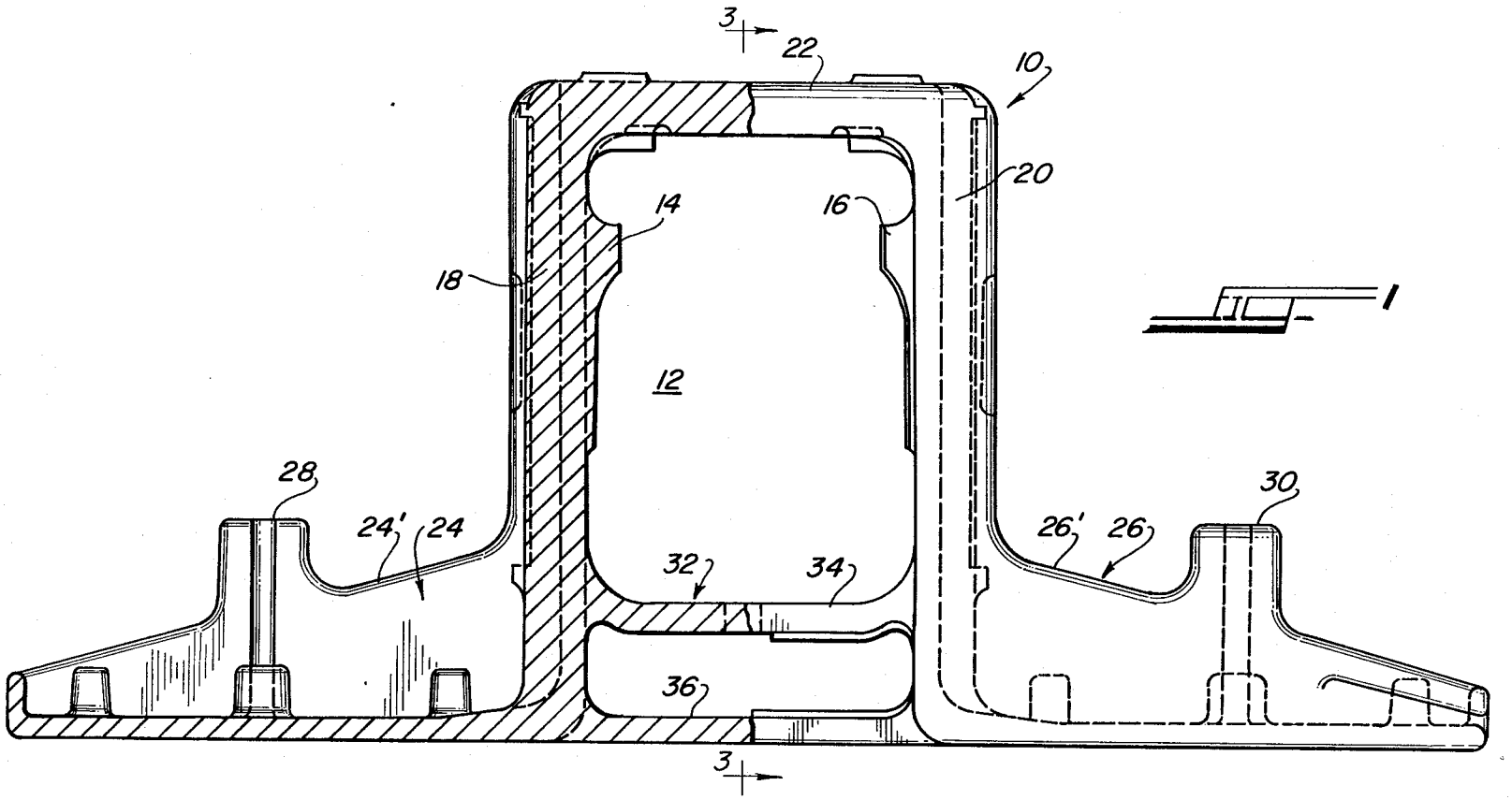
FIG. 1 is a side elevational view of the improved saddle frame of the invention, viewed from the outboard side thereof.

Referring now to the drawings in greater detail, the improved saddle frame for a single-axle truck for a railway freight car is indicated generally by reference numeral 10 in FIG. 1. It is to be understood that two such saddle frames 10 are provided for the axle of a single-axle truck. The saddle frame 10 defines a hollow interior 12 with laterally, inwardly-projecting thrust lugs 14 and 16, projecting toward each other from the interior surfaces of the pair of upright and spaced columns 18 and 20. The lateral thrust lugs 14 and 16 also define the longitudinal bearing and adapter abutment surfaces which locate the roller-bearing adapter longitudinally within the hollow interior 12. The upper roof section 22, on the lower surface thereof, is designed to receive a replaceable rocker seat, which has a cylindrical crown facing downwardly to interface with the reverse crown of the roller-bearing adapter assembly, permitting a reverse pendulum, lateral swing of the saddle frame, and allowing the roller-bearing adapter assembly a larger amount of lateral movement than normally found in conventional trucks, which does not constitute the subject matter of the present invention.

Lateral contact surfaces 28 and 30 extend upwardly beyond the slope 24' and 26', respectively, of the spring seat flanges or arms 24 and 26, which lateral contact surfaces are interfaced with the car pedestal guide-arms (not shown). The saddle frame 10 also includes a lower, center web section indicated generally by reference numeral 32, and includes an upper lateral flange 34 and lower lateral flange 36. As shown in FIG. 4, the prior art flanges 34 and 36 have equidistantly-extending inboard and outboard sections 34', 34'', and 36', 36'', respectively, with sections 34' and 36' being the inboard-extending sections. Each of these prior art sections 34', 34'', 36', and 36'' are of equal length and width, and are of substantially the same configuration throughout. Furthermore, each of the sections extends inwardly and outwardly from the longitudinal center line of the saddle frame, which center line extends parallel to the length of the saddle frame as taken in the direction from column 18 toward column 20, the same distance, as clearly shown in FIG. 4. The upper flange 34 is provided with a conventional hole 37 for mounting the wheel adapter and bearing assembly retainer thereto for increased stability. The inboard sections 34' and 36', as set forth above, extend the same distance from the longitudinal center line of the saddle frame as the outboard sections 34'' and 36'', which thereby obstruct the passage of infrared beams to an inboard, rail bed mounted hot box detector, which hot-box detector is used for sensing the state of temperature of the wheel bearings of each axle of the truck, in a conventional manner. Typically, such a hot-box detector is mounted on the inboard side of the truck side frame, but outboard of the rail on the truck bed, receiving the infrared beams at an angle of 45 degrees with respect to the horizontal plane as seen from the side of the car or truck. Typically, a hot-box detector is positioned a short distance from the rail head. The hot-box detector receives and senses the infrared rays from the wheel bearing being checked, to determine the state of temperature of the bearing and check its proper functioning. Such hot-box detectors are manufactured, for example, by the Servo Corporation of America, Hicksville, N. Y., as well as by Harmon Industries, Inc. of Grain Valley, Mo. It has been found, however, that the inboard sections 34' and 36' offer substantial obstruction to the passage of these infrared beams to the hot-box detector, and have prevented the trouble-free sensing of infrared beams by these hot-box detectors, since the inboard projections of each of these inboard sections 34' and 36' are such that they intersect with the path of the infrared beam to the hot-box detector from the wheel bearing. In accordance with the present invention, the inboard sections 34' and 36' have been considerably shortened, as indicated in FIG. 3.

Figure 3:
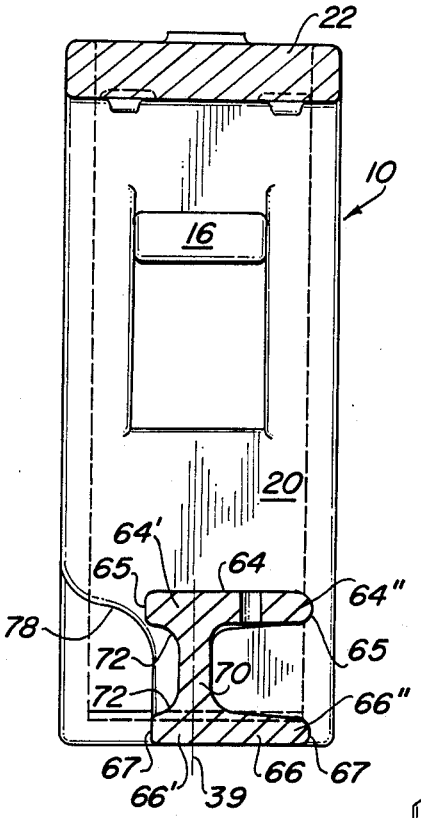
FIG. 3 is a cross-sectional view taken along line 3—3 of FIG. 1.
Figure 4:
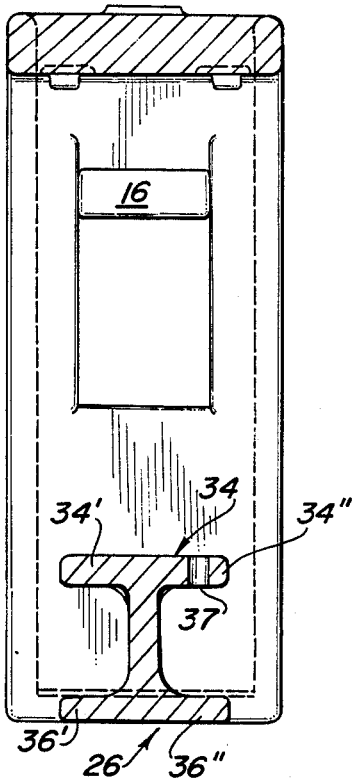
FIG. 4 PRIOR ART
FIG. 4 is a view similar to FIG. 3, showing the pair of lower flanges of the conventional, prior art saddle frame of a single-axle truck for a railway freight car.

Referring now to FIG. 3, the upper and lower flanges 64 and 66 of the center web section 32 include inboard sections 64' and 66', and outboard sections 64'' and 66''. Each of the inboard and outboard sections of each of the upper and lower flanges is different from the prior art sections shown in FIG. 4, which differences have been made in order to allow for the unobstructed passage of the infrared beams to the hot-box detector from the wheel bearing above the flanges 64 and 66, as well as to provide the necessary structural integrity and load-absorption capabilities for each flange, owing to the fact that the inboard sections 64' and 66' have been shortened to allow for the unobstructed passage of the infrared beams from the wheel bearing thereabove. As can be seen in FIG. 3, each inboard section 64' and 66' is considerably shorter in width than the outboard sections 64'' and 66'', respectively. In the prior art flanges 34 and 36, the width of each inboard and outboard section, which width is taken from the longitudinal center line of the saddle frame toward the inboard/outboard side respectively, is $2\frac{1}{4}$ inches, for a total width of the respective upper and lower flange of $4\frac{1}{2}$ inches. For flanges 64 and 66 of FIG. 3, the total width of the upper flange 64 is $4\frac{3}{8}$ inches, while the total width of the lower flange is $4\frac{1}{8}$ inches, a differential of $\frac{1}{4}$ inch. This differential is provided because the infrared beams are more generally obstructed by the inboard section 66' of the lower flange 66 than the inboard section 64' of the upper flange 64. Each of the outboard sections 64'' and 66'' is of equal width of 3 inches, with the inboard section 64' being $1\frac{3}{8}$ inches, while the inboard section 66' is $1\frac{1}{8}$ inches. Thus, the differential in total widths of the upper and lower flanges is embodied in the inboard sections' widths. Because these inboard sections 64' and 66' are shorter in width than the inboard sections of the prior art, as well as shorter in width than the outboard sections 64'' and 66'' of the improved saddle frame 10, provisions have been made in the center web section 32 in order to strengthen the center web section in order to offset the compromises made by the shortening of inboard sections 64' and 66'. Each of the outboard sections 64'' and 66'' of the invention has an outboard-most thickness 65 and 67, when viewing FIG. 3, of $\frac{3}{4}$ inch, with each outboard section 64'' and 66'' tapering progressively toward the opposite outboard section to form a greater thickness as each of these outboard sections approaches the longitudinal center line 39. The taper in the preferred embodiment is 5 degrees, compared with a minimum tapering of one degree in prior art flanges 34 and 36. Thus, at the portions of the outboard sections 64'' and 66'' lying closer to the longitudinal center line 39 of the saddle frame, greater load-bearing capacity is achieved to thereby offset the reduction in width of each of the inboard sections 64' and 66' which, in combination with the increased width of each of the outboard sections 64'' and 66'' to a total of three inches as compared to the total length of $2\frac{1}{4}$ inches of the prior art outboard flanges 34'' and 36'', more than adequately provide for maximum load-bearing capacity in a manner that actually surpasses the load-bearing capacity of the prior art flanges 34 and 36.

With regard to the inboard sections 64' and 66', as mentioned above, although they are reduced in total width as compared to the prior art sections 34' and 36', the load-bearing capacity thereof has been strengthened by making each of these sections 64' and 66' of increased thickness. Each of the prior art sections 34' and 36' are of same constant thickness of 3/4 inch, whereas each of the inboard sections 64' and 66' starts, at the inboard end thereof 65' and 67', with a thickness of $\frac{7}{8}$ inch, and progressively tapers toward the opposite flange for increasing the thickness of each of these inboard sections, the thickness increasing as each of the portions of the sections approaches the vertical connecting wall 70 of the center web section 32. This increase in thickness of each of the inboard sections, as the portions thereof progressively approach the longitudinal center axis 39 of the saddle frame, is achieved via a gradual change as defined by the radius of curvature indicated by reference numeral 72 in FIG. 3 or $\frac{3}{4}$ inch, which radius of curvature originates substantially adjacently the inboard end 65' and 67' of each of the respective inboard sections, to thereby also effectively thicken the upper and lower portions of the connecting wall 70, to thereby also provide additional load-bearing capacity to this wall section 70.

Figure 2:
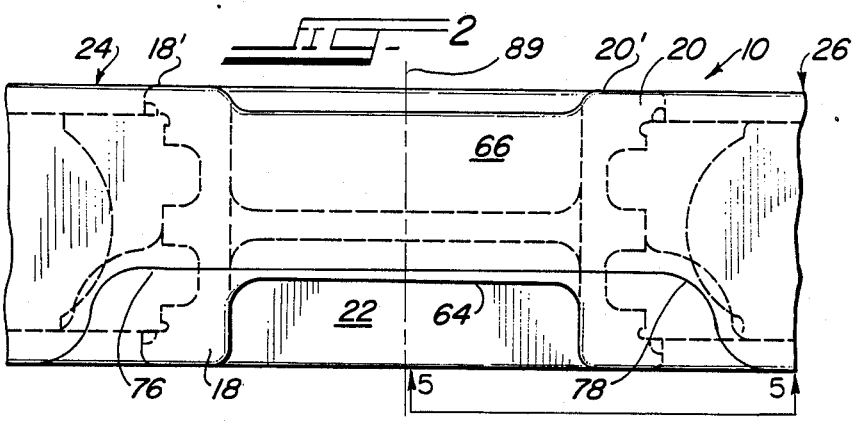
FIG. 2 is a bottom view thereof.
Figure 5:
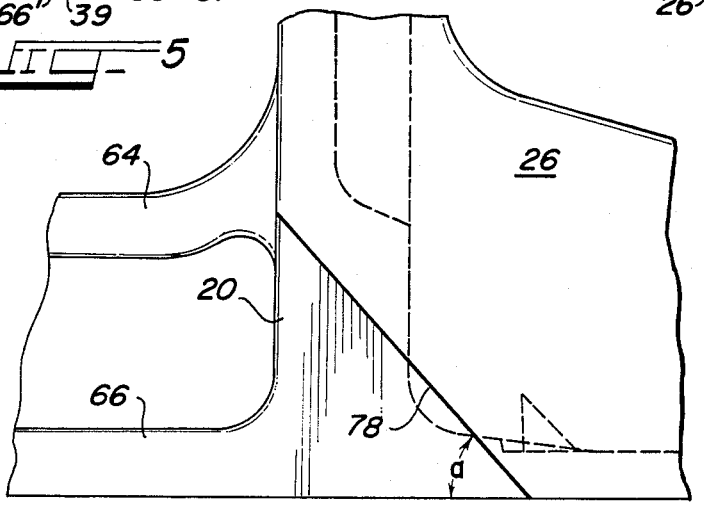
FIG. 5 is a side view taken along line 5—5 of FIG. 2.

In addition to the cutting back of the inboard flange sections 64' and 66', the directly adjacent and connected lower portions of the columns 18 and 20, and associated connected portions of the arms 24 and 26, are also cut back in order to allow for the infrared rays emanating from the respective bearing to bypass the inboard side of the saddle frame 10 and reach the hot-box detector. With reference to FIG. 2, it may be seen that the directly adjacent and connected lower inboard portions of the columns 18 and 20 are cutout for a substantial distance originating at the interior surface of the respective column longitudnally away therefrom, preferably a distance representative of at least one-half of the length of each of the flanges 34 and 36. The line of contour defining this cutout portion for each of the inboard portions of the columns 18 and 20 is indicated generally by reference numeral 76 and 78, respectively. It is evident from FIG. 2 that the beam of infrared rays emanating from the wheel bearing positioned within the hollow interior 12 of the saddle frame will have ample clearance with respect to the inboard lower portions of the columns 18 and 20 to bypass them and reach the hotbox detector. Each of the lower, inboard cutout portions of the columns 18 and 20 slope upwardly at an angle "a", shown in FIG. 5, which is preferably a 45 degrees, which is the angle of incidence upon the hot-box detector. It is clear from FIG. 2 that each of the cutout portions of the lower inboard side sections of the columns 18 and 20, and associated spring arms 24 and 26, tapers inboardly until it reaches the full width of the associated spring arm 24, 26 at a substantial distance away, in the longitudinal direction, from the distal ends of the lower flanges 34 and 36. In viewing FIG. 2, in the preferred embodiment, the total lateral width of each of the columns 18 and 20, taken in direction perpendicular to the longitudinal center line of the saddle frame in a direction from the outboard toward the inboard side of the saddle frame, is 7¼ inches, with the inboard cutout section 76, 78 of each of the columns 18 and 20 and associated arms 24 and 26 originating at a line from the outboard side edge 18' toward the inboard side a distance of 4¾ inches, and then tapers downwardly and inboardly until it reaches the maximum width of 7¼ inches thereof at a distance of 10½ inches from the lateral bisecting plane indicated generally by reference numeral 89 in FIG. 2.

The present invention allows for the exposure of the inboard portion of the roller-bearing, inner-seal cover and backing ring of the roller-bearing, to a much larger degree and for a longer time period than hitherto possible.

While a specific embodiment of the invention has been shown and described, it is to be understood that numerous changes and modifications thereof may be made without departing from the scope, spirit and intent of the invention, as set out in the appended claims.

What is claimed is:

1. In a saddle frame for a single-axle truck for a railway freight car, in which said saddle frame has a longitudinal center line thereof and comprises a lower, center web section having a pair of horizontally-disposed, parallel, vertically spaced-apart lower flanges, a pair of upright columns, and an upper wall portion interconnecting upper portions of said pair of columns, said saddle frame defining a substantially hollow interior in which may be received a wheel bearing set, and a pair of spring arms associated with said pair of upright columns, one said spring arm associated with one said upright column and connected to and extending longitudinally from a lower portion of the respective said upright column, each of said pair of upright columns, said spring arms, and said lower flanges defining an inboard side thereof and an outboard side thereof, wherein the improvement comprises:

each of said pair of lower flanges comprising a first outboard section and a second inboard section, said longitudinal center line demarcating the boundary between said inboard section and said outboard section, each said inboard section having an inboard-most side edge-surface, said inboard section of each of said pair of lower flanges being cut back a distance such that said inboard-most side edge-surface thereof is, in the horizontal direction, spaced from the inboard-most side edge-surfaces of said spring arms and said columns, said horizontal distance being transverse to said longitudinal center line and extending from the inboard side to the outboard side; each said inboard section being cut back a distance allowing for the unobstructed passage of infrared rays from a respective wheel bearing mounted by the saddle frame to an infrared ray-detecting hot-box detector mounted on the rail bed, whereby the hot-box detector may sense the state of operating temperature of each wheel bearing.

2. In a saddle frame for a single-axle truck for a railway freight car, in which said saddle frame has a longitudinal center line thereof and comprises a lower center web section having a pair of horizontal-disposed, parallel, vertically spaced-apart lower flanges, a pair of upright columns, and an upper wall portion interconnecting upper portions of said pair of columns, said saddle frame defining a substantially hollow interior in which may be received a wheel bearing set, and a pair of spring arms associated with said pair of upright columns, one said spring arm associated with one said upright column and connected to and extending longitudinally from a lower portion of the respective said upright column, each of said pair of upright columns, said spring arms, and said lower flanges defining an inboard side thereof and an outboard side thereof, wherein the improvement comprises:

each of said pair of lower flanges comprising a first outboard section and a second inboard section, said longitudinal center line demarcating the boundary between said inboard section and said outboard section, said outboard section having a greater width than said inboard section, said width being taken in a horizontal direction transverse to said longitudinal line from the outboard side toward the inboard side, whereby infrared rays from a wheel bearing set mounted in said saddle frame may be exposed to allow for unobstructed passage of the infrared rays to a hot-box detector mounted on the inboard side of the truck side frame, but outboard of the rail on the rail bed, so that the state of operating temperature of the wheel bearing of a respective wheel set may be gauged by the hot-box detector.

3. The improvement according to claim 2, wherein said inboard section of the upper one of said pair of lower flanges is of greater width than said inboard section of the lower one of said pair of lower flanges.

4. The improvement according to claim 3, wherein said inboard section of said upper one of said pair of lower flanges is approximately one-quarter inch greater in width than said inboard section of said lower one of said pair of lower flanges.

5. The improvement according to claim 3, wherein said outboard section of each of said pair of flanges comprises an outboard-most edge surface in close proximity to the outboard-most edge surface of said pair of upright columns and said pair of spring arms; said inboard section of the upper one of said pair of lower flanges having an inboard-most edge surface spaced in said horizontal direction from the inboard-most edge surface of said upright columns and spring arms.

6. The improvement according to claim 2, wherein each said inboard side of each of said pair of upright columns and a pair of spring arms comprises a cutout portion having a top portion originating directly adjacent a respective longitudinal end of the upper one of said pair of lower flanges and sloping downwardly therefrom at a chosen slope and terminating at a bottom portion spaced longitudinally away from a respective end of the lower of said pair of lower flanges, whereby the infrared rays from a wheel bearing has ample clearance to bypass the inboard sides of said pair of columns and spring arms in order to impinge upon an infrared-sensing hot-box detector.

7. The improvement according to claim 6, wherein said slope of each said cutout portion is approximately forty-five degrees.

8. The improvement according to claim 6, wherein each said cutout portion of each said pair of columns and pair of spring arms has a maximum width at said top portion thereof adjacent the respective said longitudinal end of said upper one of said pair of lower flanges and decreases in width as said cutout portion approaches said bottom portion thereof, whereby the respective said column and spring arm reaches its maximum width at the portion thereof defined by said bottom portion of the respective said cutout portion.

9. The improvement according to claim 8, wherein each said cutout portion slopes downwardly from said top portion therof to said bottom portion thereof at a forty-five degree angle in order to match the forty-five degree angle of incidence for which aninboard, rail-mounted, hot-box detector receives and senses infrared rays from the wheel bearing.

10. The improvement according to claim 2, wherein said outboard section of each said pair of lower flanges has an increasing thickness from the outboard-most edge surface thereof toward said longitudinal center line, said thickness being measured in a vertical direction perpendicular to said longitudinal center line.

11. The improvement according to claim 10, wherein said outboard section of said upper one of said pair of lower flanges comprises a bottom surface wall, and said outboard section of said lower one of said pair of lower flanges comprises a top surface wall; said bottom surface wall sloping downwardly at an angle from the outboard side toward the inboard side, and said top surface wall sloping upwardly from the outboard side toward the inboard side at an angle.

12. The improvement according to claim 11, wherein said center web section comprises a central connecting hub section interconnecting said pair of lower flanges, said hub section extending generally vertically between said pair of lower flanges; said bottom surface wall arcuately transforming into an upper part of said hub section, and said top surface wall arcuately transforming into a lower part of said hub section.

13. The improvement according to claim 2, wherein said inboard section has a greater thickness than said outboard section.

14. The improvement according to claim 13, wherein said thickness of said inboard section increases from the inboard side thereof to the outboard side thereof.

15. The improvement according to claim 14, wherein said inboard section of the upper one of said pair of lower flanges comprises a bottom surface wall defining a concave shape; and said inboard section of said lower one of said pair of lower flanges comprises a top surface wall defining a concave shape; said web section comprising a hub section, said top surface wall transforming into an upper part of said hub section, and said bottom surface wall transforming into a lower part of said hub section.

16. The improvement according to claim 15, wherein said hub section has a thickness of three-fourths inch, said thickness of said hub section being taken in a direction from the outboard side toward the inboard side; each said inboard section of said pair of lower flanges having a minimum thickness at the inboard-most edge thereof of seven-eighths inch; and each said outboard section having a minimum thickness at the outboard-most edge thereof of three-fourths inch.

* * * * *